United States Patent [19]

Möckesch

[11] 4,256,150

[45] Mar. 17, 1981

[54] METHOD OF FILLING A PLASTIC BAG IN A PRESSURE TANK WITH A CARBONATED BEVERAGE, IN PARTICULAR BEER

[75] Inventor: Erich Möckesch, Heilbronn, Fed. Rep. of Germany

[73] Assignee: Bier-Drive AG, Switzerland

[21] Appl. No.: 27,652

[22] PCT Filed: Apr. 4, 1979

[86] PCT No.: PCT/EP78/0009

§ 371 Date: Apr. 11, 1979

§ 102(e) Date: Apr. 4, 1979

[87] PCT Pub. No.: WO79/00093

PCT Pub. Date: Mar. 8, 1979

[51] Int. Cl.[3] ..... B65B 3/04; B65B 3/16

[52] U.S. Cl. ..... 141/5; 53/449; 138/30; 141/10; 141/113; 141/114; 220/85 B; 222/386.5

[58] Field of Search ..... 53/449, 175; 138/30; 141/1, 4, 5, 10, 113, 114, 313–317, 374; 220/85 A, 85 B, 461; 222/386.5, 94, 95

[56] References Cited

U.S. PATENT DOCUMENTS

| | | | |
|---|---|---|---|
| 2,991,916 | 7/1961 | Kish | 222/386.5 |
| 3,300,102 | 1/1967 | Budzich | 222/386.5 |
| 3,377,766 | 4/1968 | Nelson | 53/449 |
| 3,802,470 | 4/1974 | Coleman | 141/10 |
| 4,174,741 | 11/1979 | Parsons | 222/386.5 X |

*Primary Examiner*—Frederick R. Schmidt

*Attorney, Agent, or Firm*—Fitzpatrick, Cella, Harper & Scinto

[57] ABSTRACT

A pressure tank is to be filled with a carbonated beverage, in particular beer, without the beverage coming into contact with the walls of the pressure tank. To this end, there is inserted in the pressure tank a plastic bag into which the beverage is introduced. The plastic bag is replaced whenever the tank is to be refilled. The pressure tank is provided with two openings at opposite points which are closed by fittings. The plastic bag is introduced through one of the two openings. To prevent that as the beverage is introduced there remain folds at points of the plastic bag which are already covered by the beverage, it is proposed to introduce the plastic bag into the pressure tank along with a hoselike jacket which as the bag is being filled assures a gradual unfolding thereof.

2 Claims, 1 Drawing Figure

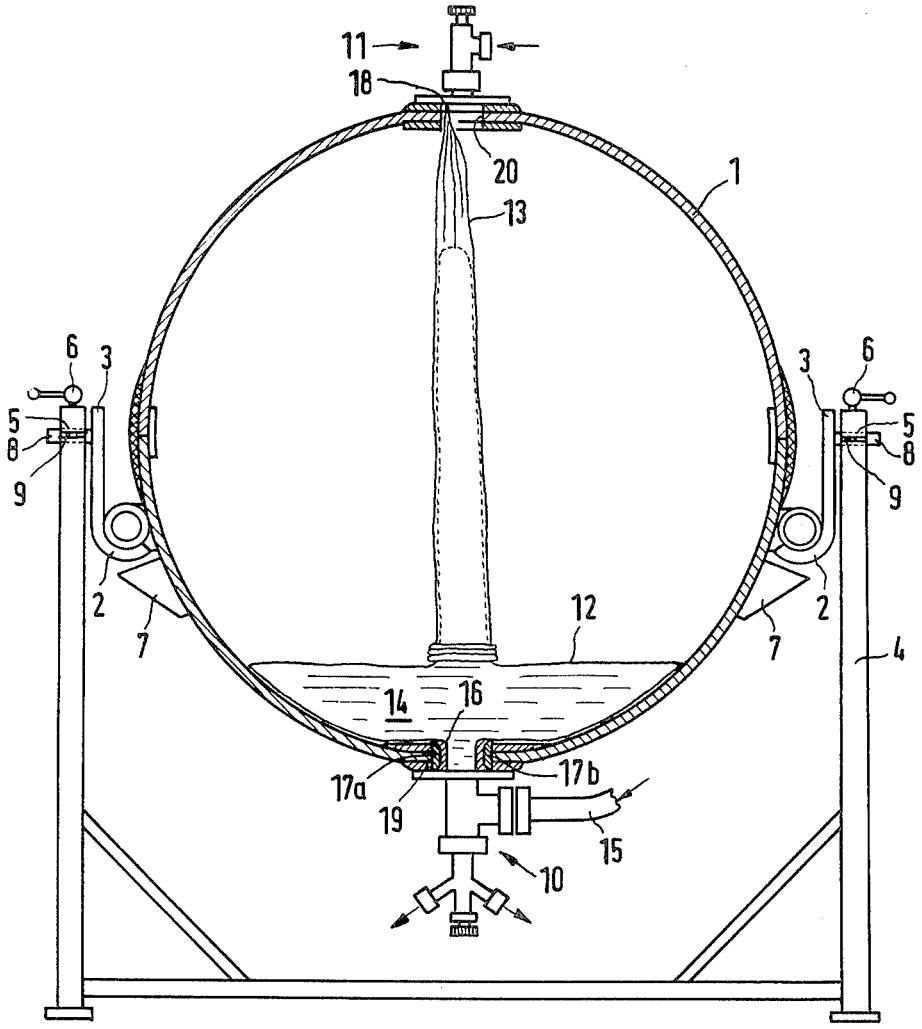
11
18
20
13
1
6
3
5
8
9
2
7
12
14
16
17a
17b
19
15
10
4

METHOD OF FILLING A PLASTIC BAG IN A PRESSURE TANK WITH A CARBONATED BEVERAGE, IN PARTICULAR BEER

The invention relates to a method of filling a plastic bag in a pressure tank with a carbonated beverage, in particular beer, the pressure tank being provided with two opposed openings, one of which is closed by a beverage fitting for filling and tapping, and the other by a compressed-gas fitting for the introduction of compressed gas between the tank wall and the plastic bag, in which method the plastic bag is introduced into the pressure tank in the folded condition through an opening therein before the fittings are mounted, a pressure-resistant flow-through connection then being established between the open end of the plastic bag and the filler fitting as the latter is mounted, and in which method compressed gas is then fed to the compressed-gas fitting, and thereupon the beverage is fed to the beverage fitting.

Such a method is known from published unexamined German patent application No. 20 50 376. The pressure tank used in the prior-art method has roughly the shape of a drum. For insertion of a plastic bag, the pressure tank is placed horizontally so that the two openings are on opposite sides. The plastic bag is inserted into the interior of the pressure tank in a collapsed and specially folded condition through the opening which is closed by the beverage fitting. The plastic bag is also filled with the pressure tank in the horizontal position. The plastic bag then is to unfold gradually.

The difficulties with such a method consist in preventing that as the beverage is introduced there remain folds at points of the plastic bag already covered by the beverage. Because of the weight of the liquid these folds cannot be removed by continuing to fill the plastic bag without running the risk that the latter will burst.

It is a known fact that a pressure tank having a given wall thickness can withstand maximum pressure when it is of spherical design. However, filling without folds is particularly difficult in the case of a spherical pressure tank.

Thus the invention has as its object to provide a method of filling a plastic bag without folds in a pressure tank which may also be spherical.

This object is accomplished by inserting the plastic bag in the pressure tank along with a hoselike jacket which remains in the pressure tank as the plastic bag is being filled.

It should be noted at this point that the use of a hoselike jacket with a plastic bag is known in principle, but only for the purpose of protecting the plastic bag against damage until it is inserted in the pressure tank. The protective jacket is removed just before the plastic bag is introduced into the pressure tank. In contradistinction thereto, in the method in accordance with the invention the jacket is to remain on the plastic bag also in the pressure tank.

In filling, the jacket releases only a portion of the plastic bag corresponding to that needed by the introduced liquid to form a plastic-sheet-covered liquid level in the pressure tank. The rest of the plastic bag remains in an orderly fashion in the jacket. In this way, the plastic bag cannot form folds below the liquid level. When completely filled, the plastic bag has fully emerged from the jacket. The jacket remaining between the plastic bag and the inside wall of the tank is not in the way since this space will be filled only with compressed gas.

An advantageous refinement of the method in accordance with the invention may consist in the pressure tank being oriented so prior to introduction of the plastic bag that the opening to be closed by the compressed-gas fitting is at the top; that the plastic bag with the jacket is introduced into the pressure tank from the top through that opening, the open end of the plastic bag being directed downwardly; and that the jacket by its upwardly directed end is fastened in the area of said opening to the pressure tank or to the compressed-gas fitting.

By being so fastened, the jacket can readily be removed from the pressure tank when the plastic bag is replaced.

An exemplified embodiment of the invention is described below with reference to the drawing.

The FIGURE shows a section through a pressure tank with a plastic bag and a jacket.

In the FIGURE, a pressure tank composed of two hemispheric half shells is designated 1. The hemispheric half shells are made of a plastic. The spherical pressure tank 1 is set into a ring 2 which makes contact with the pressure tank 1 along a meridian line. The ring 2 consists of a pipe that is joined to two hinge members 3. Each of the two hinge member 3 is provided with a shaft stud 8. The two shaft studs extend in the equatorial plane of the pressure tank 1. They are mounted in pivot bearings 5 of a rack 4. To one side of the shaft studs 8 the pivot bearing 5 is provided with a gap 9 through which a screw 6 extends. This screw 6 may be tightened manually, and in this way the shaft stud 8 may be fixed in any position. Consequently the pressure tank 1 may also be fixed in any position. Also mounted on the pressure tank 1 are abutment members 7 which prevent the pressure tank from dropping out of the ring 2 when the latter is above the equator.

In the position illustrated, the pressure tank 1 has an opening 20 at the top and an opening 19 at the bottom. The opening 20 is closed by a fitting 11 for the injection of compressed gas. The opening 19 is closed by a fitting 10 for the introduction of beer and for discharge. The beer is introduced into the fitting 10 through a pipe 15.

In the opening 19, a collarlike ring 16 is seated which forms the open end of a plastic bag 12. The collarlike ring 16 is held in the opening 19 by means of two removable ring halves **17*a* and 17*b***. This type of fastening is known from German patent application No. 20 50 376 and is not a part of the invention.

The plastic bag 12 is partly still in a hoselike jacket 13 which at its upper end is fastened to a button 18 provided on the compressed-gas fitting 11.

The method works as follows: When a pressure tank 1 has been emptied, the two fittings 10 and 11 are removed from the pressure tank. Removal of the ring halves **17*a* and 17*b* permits the emptied plastic bag 12 to be pulled out of the opening 19. The jacket 13 may be pulled out of the opening 20 with the compressed-gas fitting 11. A new plastic bag 12 with a jacket 13 is now dropped into the tank 1 from the top through the opening 20 and the appropriate end of the jacket 13 is fastened to the button 18 on the compressed-gas fitting 11. The latter may then be mounted on the opening 20. At the end of the plastic bag 12 sticking out of the jacket 13 is the collarlike ring 16. This will drop through the opening 19 by itself or may be pulled by hand through the opening 19. Setting the ring halves 17*a* and 17*b* into the opening 19 then fixes the collar 16 in said opening. The fitting 10 may then be mounted on the opening 19 and screwed tight. Compressed gas is then injected into the tank 1 through the fitting 11. Thereupon beer is introduced into the fitting 10 through the pipe 15. The beer flows into the plastic bag 12 against the pressure in the pressure tank 1 and forms a liquid bed 14 whose surface is covered with the sheeting of which the plastic bag 12 is made. As filling of the tank continues, the plastic bag 12 is pulled steadily farther out of the jacket 13, assurance being provided that the plastic bag 12 will not form folds under the liquid bed 14**.

I claim:

1. A method of filling a plastic bag in a pressure tank with a carbonated beverage, in particular beer, the pressure tank being provided with two opposed openings, one of which is closed by a beverage fitting for filling and tapping, and the other by a compressed-gas fitting for the introduction of compressed gas between the tank wall and the plastic bag, in which method the plastic bag is introduced into the pressure tank in the folded condition through an opening therein before the fittings are mounted, a pressure-resistant flow-through connection then being established between the open end of the plastic bag and the filler fitting as the latter is mounted, and in which method compressed gas is then fed to the compressed-gas fitting, and thereupon beverage is fed to the beverage fitting, characterized by the fact that the plastic bag (12) is introduced into the pressure tank (1) inside a hoselike jacket (13), said plastic bag (12) being pulled out of said jacket (13) and said jacket remaining in the pressure tank (1) while the plastic bag (12) is being filled.

2. A method as defined in claim 1, characterized by the fact that the pressure tank (1) is oriented so prior to the introduction of the plastic bag (12) that the opening (20) to be closed by the compressed-gas fitting (11) is at the top; that the plastic bag (12) with the jacket (13) is introduced into the pressure tank (1) from the top through that opening (20), the open end of the plastic bag being directed downwardly; and that the jacket (13) by its upwardly directed end is fastened in the area of said opening (20) to the pressure tank (1) or to the compressed-gas fitting (11).

* * * * *